US005232553A

United States Patent [19]

Smigo et al.

[11] Patent Number: 5,232,553

[45] Date of Patent: Aug. 3, 1993

[54] FINES RETENTION IN PAPERMAKING WITH AMINE FUNCTIONAL POLYMERS

[75] Inventors: John G. Smigo, Macungie; Robert K. Pinschmidt, Allentown; Andrew F. Nordquist, Whitehall, all of Pa.; Timothy L. Pickering, Radford, Va.

[73] Assignee: Air Products and Chemicals, Inc., Allentown, Pa.

[21] Appl. No.: 826,330

[22] Filed: Jan. 24, 1992

[51] Int. Cl.[5] ..... D21H 17/45

[52] U.S. Cl. ..... 162/147; 162/164.6; 162/166; 162/167; 162/168.2

[58] Field of Search ..... 162/164.6, 168.2, 147, 162/166, 167

[56] References Cited

U.S. PATENT DOCUMENTS 3,840,489 10/1974 Stazdins ..... 260/29.6 TA
4,421,602 12/1983 Brunnmueller et al. ..... 162/168.2
4,808,683 2/1989 Itagaki et al. ..... 526/307.2
4,843,118 6/1989 Lai et al. ..... 524/555
4,895,621 1/1990 Hassler ..... 162/168.2

FOREIGN PATENT DOCUMENTS 6151006 2/1990 Japan .

*Primary Examiner*—Peter Chin
*Attorney, Agent, or Firm*—Mark L. Rodgers; William F. Marsh; James C. Simmons

[57] ABSTRACT

Polyvinylaminals, optionally as the formed copolymer with polyvinyl hemiaminals, and polyvinyl acetals are added to a papermaking pulp slurry to improve the retention of fines in the final paper product. This polymer is provided by reacting a poly(vinylamine) which can be a homopolymer or a copolymer containing vinyl alcohol and vinyl amine units with a monoaldehyde. The aldehyde, such as butyraldehyde, modifies the structure of the polymer and increases its hydrophobicity. The use of these polymers in papermaking involving the recycle of waste papers provides notable advantages in fines retention because of the high level of fines which normally accompany such recycle paper waste.

19 Claims, 2 Drawing Sheets

FINES RETENSION
C4 MODIFIED PVAm-HCl
% FINES RETENSION IMPROVEMENT
80
60
40
20
0
-20
0
0.2
0.4
0.6
0.8
1
1.2
1.4
% POLYMER
A
B
C
D

FINES RETENTION IN PAPERMAKING WITH AMINE FUNCTIONAL POLYMERS

CROSS-REFERENCE TO RELATED APPLICATIONS

This application relates to copending application Ser. No. 525,377 filed May 17, 1990.

FIELD OF INVENTION

This invention relates to a papermaking process using a polyvinyl aminal to aid in fines retention. In another aspect it relates to the processing of recycle wastepaper containing fines using a reaction product of poly(vinylamine) and aldehyde for increased retention of the fines in the paper product.

BACKGROUND OF THE INVENTION

In papermaking processes, fibrous pulp is slurried in water and various particulate materials are added to improve the quality of the paper product. Such materials are often fillers, for example clays, starch, calcium carbonate, and the like. Such fillers and small cellulose fibers which tend to separate from the bulk of the paper fiber are referred to generically as fines.

It is important in papermaking to obtain good retention of fines in the paper product. Good fines retention helps to achieve better and more consistent final dry paper properties and permits a more efficient and cost effective usage of the pulp stock. When the retention of fines in the product is high, less pulp is used to produce the final product and the process water is much cleaner.

Fines retention becomes even more important when paper is made from recycled waste because pulp from recycled papers has a higher level of fines, under normal conditions, than the pulp used to make the original product. When these fines are not retained on the paper, cost effective usage of the recycle stock declines and the higher fines levels can lead to more frequent and costlier cleanup of the processing water.

A common method for retaining these fine particles is to add alum which negates the repulsive forces between the negatively charged cellulosic surfaces and the negatively charged filler particles. Following this, a cationic polymer is added which bridges the two types of anionic surfaces and binds them together. Presently, several types of polymers along with varying methods are used to help improve fines retention. Such polymeric types include cationic polymers such as copolymers of acrylamides and quaternary amines, anionic polymers such as copolymers of acrylamide and acrylic acid, and amphoteric polymers such as a quaternary amine and acrylic acid. Several newer systems which are now being used include blends of cationic polyacrylamides with anionic fillers, such as kaolin clays. Another type of fines retention aid is a blend of cationic starch with anionic colloidal silica.

U.S. Pat. No. 3,840,489, Strazdins (1974) discloses improving the dry strength of a paper product by adding to the pulp in the papermaking process an aqueous dispersion of a copolymer of acrylamide and a hydrophobic vinyl comonomer, such that the ratio of acrylamide linkages to hydrophobic linkages is between 60:40 and 95:5. The hydrophobic linkages are said to improve the adsorptivity of the polymer by cellulose fibers.

Amine functional polymers are known to be valuable as a cost effective way of incorporating cationic charges into the polymers. Such polymers have found utility in cationic electrocoating, water treatment and enhanced oil recovery.

U.S. Pat. No. 4,843,118, Lai, et al. (1989) discloses the use of high molecular weight (greater than $1\times10^6$) poly(vinylamines) in acidized fracturing fluids for enhanced oil recovery. Such poly(vinylamines) can be prepared by acid or base hydrolysis of poly(N-vinylformamide). Although these high molecular weight poly(vinylamines) can be used in enhanced oil recovery without crosslinking, the use of crosslinking agents, such as epichlorohydrin, is disclosed as optional. The use of dialdehyde, such as glyoxal, to crosslink poly(vinylamine) is also disclosed in Japanese Patent Publication No. J61051006 (1986).

U.S. Pat. No. 4,421,602, Brunnmueller et al. (1983) discloses partially hydrolyzed homopolymer of N-vinylformamide useful as a drainage aid in papermaking. From 10 to 90% of the formyl groups are hydrolyzed to amine units in either acid or base in making this homopolymer.

U.S. Pat. No. 4,808,683, Itagaki et al. (1989) discloses a vinylamine copolymer of N-vinylformamide and an alkyl or oxoalkyl N-substituted acrylamide or methacrylamide in which the formamide units have been partially hydrolyzed under acidic conditions to cationic amine units. The copolymer is said to be useful as a flocculating agent and in papermaking as a drainage aid and to increase paper strength.

Despite such wide variety of retention aids, there continues to be a need for even better fines retention agents as the use of recycled papers grows. Indeed, the economics of recycled paper has become an important environmental issue.

SUMMARY OF THE INVENTION

According to our invention, an improved papermaking process is provided in which the paper product is obtained from a pulp slurry containing fine particles of material which tend to separate from the bulk of the paper fibers as the product sheet is formed. An improvement in fines retention is realized by adding to the pulp slurry an amine functional polyvinylacetal, polyvinylhemiaminal or polyvinylaminal (hereinafter collectively "polyvinylaminal") which is the reaction product of monoaldehyde and poly(vinylamine) or a polyvinylalcohol/polyvinylamine copolymer. Our invention is especially important in the use of recycled paper pulp which in the papermaking process is worked up in an aqueous slurry prior to separating the paper fiber from the water in the slurry. Recycled wastepaper contains fines which are difficult to retain with the paper fibers which form the product. Such fines which remain in the process water create transfer and disposal problems in papermaking processes which use recycle paper pulp. The retention of fines in such a process is improved according to our invention by adding to the pulp slurry as a retention agent, an amine functional polymer containing acetal groups and having monomeric units randomly joined in the proportions and structures indicated by the formula I:

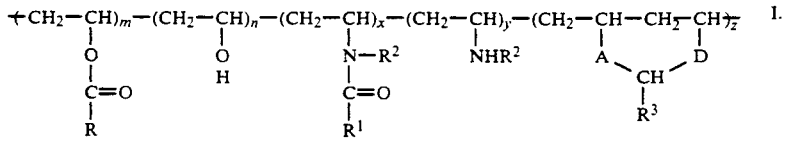

I.

wherein m, n, x, y and z are integers which added together equal a sum, m is 0 to 15 percent of said sum, n is 0 to 94 percent of said sum, x is 0 to 30 percent of said sum, y is 1 to 95 percent of said sum, z is 1 to 60 percent of said sum;

A and D are O or $NR^2$,

R is H, $C_1$-$C_{11}$ alkyl, phenyl, or $-CF_3$, $R^1$ is H or methyl, $R^2$ is H or $C_1$-$C_4$ alkyl or hydroxyalkyl, and $R^3$ is H, $C_1$-$C_{20}$ alkyl, phenyl or hydroxyphenyl.

DETAILED DESCRIPTION OF INVENTION

Figure 1:
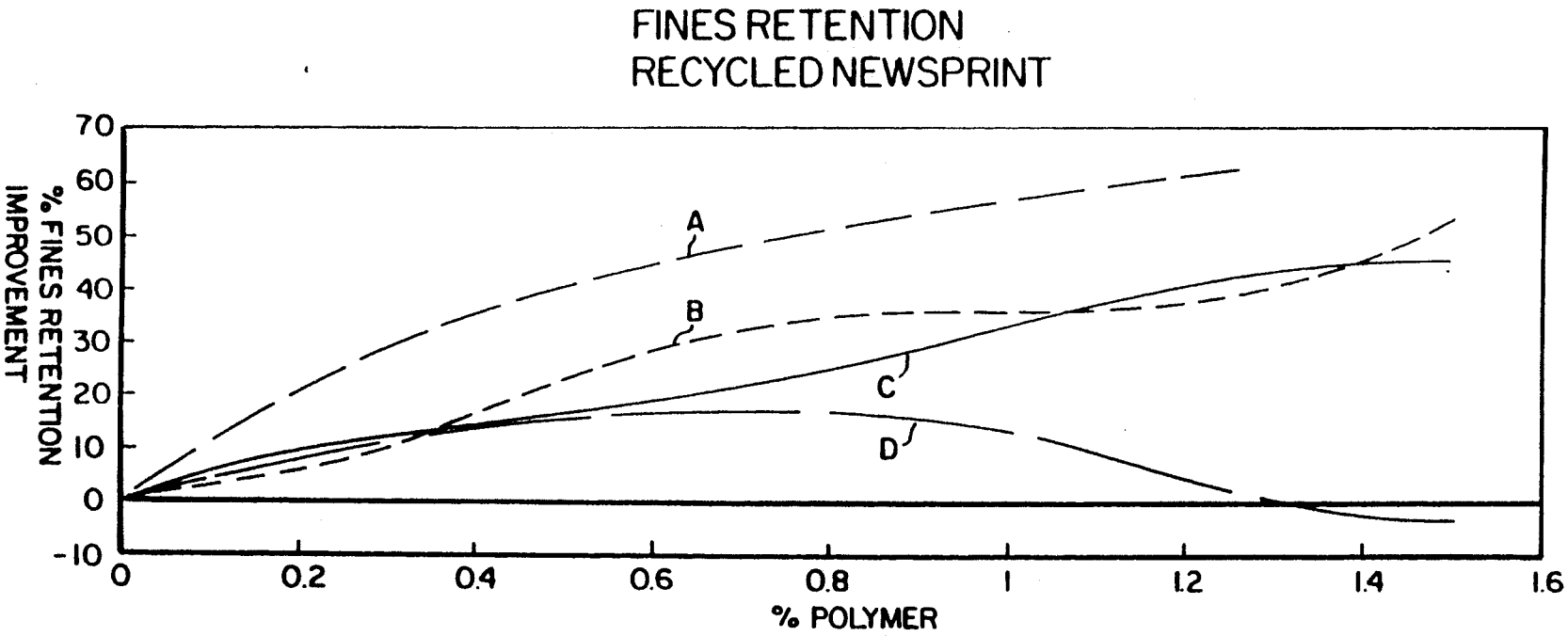
FIG. 1 is a graph plotting fines retention improvement against polymer usage level in recylced newsprint, comparing the polymer of this invention with other polymeric paper additives.

Amine functional polymers used to practice the improved papermaking process of this invention are descried in copending patent application Ser. No. 525,377 filed May 17, 1990, the full disclosure of which is incorporated herein by reference.

These polymers are referred to as polyvinylaminals, hemi-aminals and amine functional polyvinylacetals and are prepared by condensation of a poly(vinylamine), which can be a homopolymer (PVAm) or a polyvinyl alcohol/polyvinyl amine copolymer (PVOH/PVAm), with aldehydes in the presence of an acid catalyst. The compounds (generically polyvinyl-aminals) which are thus prepared can exist either as a salt free, amine functional form or, depending upon the pH of the solution, as a cationic ammonium polyvinylaminal. It is to be understood that the description and reference to these polyvinylaminals, unless otherwise indicated, includes both the salt free, amine functional polymer and the cationic ammonium salt.

The aminalization processes which can be used to prepare amine functional polyvinylaminals are similar in procedure to the processes disclosed by Lindemann, *Encyclopedia of Polymer Science and Technology*, Vol. 14, pp. 208-239 (1971), for preparing polyvinylacetals from polyvinyl alcohol. These include homogeneous, heterogeneous, precipitation and dissolution methods. Among these, it is preferred to use the homogeneous method for preparing the amine functional polyvinylacetals in order to increase the degree of aminalization and obtain a more uniform distribution of the intramolecular aminal groups. The method for aminalizing PVOH/PVAm consists of the following steps:

(a) dissolving the PVOH/PVAm in water or a water-alcohol mixture.

(b) optionally, adjusting the pH of the solution to between 1 and 4 with an acid catalyst.

(c) while mixing, adding the aldehyde to the PVOH/-PVAm solution. The aldehyde is either neat or dissolved in an alcohol.

(d) heating the resulting solution to temperatures of about 30° to 80° C. for 0.5 to 5 hours.

(e) recovering the amine functional polyvinylaminal by adjusting the solution pH to >10 with caustic such as NaOH or KOH, to cause the precipitation of the polymer.

(f) washing the polymer with an alcohol.

PVAm is aminalized by a procedure identical to the above PVOH/PVAm aminalization except, in step (e) instead of adding caustic, the aminalized polymer is recovered by adjusting the pH to <1 with an acid such as hydrochloric acid.

The polymers which are reacted with aldehydes in order to prepare the amine functional polyvinylaminals are poly(vinylamines), including homopolymers or copolymers of vinyl alcohol and vinylamine. These polymers can be represented by the following formula II which indicates the structure and proportions of the monomer units but not their order because the copolymerization is random.

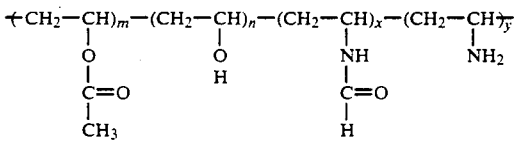

II.

wherein m, n, x and y are integers which added together equal a sum, m is 0 to 15 percent of said sum, n is 0 to 99 percent of said sum, x is 0 to 30 percent of said sum and y is 1 to 100 percent of said sum. Such polymers can be formed by the hydrolysis of poly(N-vinylamides) or copolymers of vinyl esters, e.g. vinyl acetate, and N-vinylamides, e.g. N-vinylformamide. It is acceptable for unhydrolyzed moieties of both the ester and amide groups to remain in the polymer as indicated by the above structural formula, but preferably the amount of remaining ester groups will not exceed 2 mol % of the monomer units in the polymer and the number of unhydrolyzed amide groups will not be over 30 mol %. of the amide groups.

A preferred method for preparing high molecular weight PNVF (homopolymer) by emulsion polymerization and subsequent solution hydrolysis to PVAm is given in U.S. Pat. No. 4,798,891 (1989). For lower molecular weight PVAm preparation, solution polymerization and solution hydrolysis as described in U.S. Pat. No. 4,421,602 (1983) are the preferred methods.

A preferred method of preparing copolymers of vinyl alcohol and vinyl amine includes the following steps:

(a) continuously feeding vinyl acetate monomer and N-vinyl-formamide monomer into a reaction mixture in a reaction vessel, (b) copolymerizing the vinyl acetate monomer and N-vinylformamide to yield poly(vinyl acetate)-co-poly(N-vinylformamide) [PVAc/PNVF] in the reaction mixture, (c) continuously withdrawing from the reaction vessel reaction mixture containing the PVAc/PNVF, (d) hydrolyzing the acetate functionality of the PVAc/PNVF in a methanolic medium to yield a vinyl alcohol copolymer as a gel swollen with methanol and methyl acetate, (e) comminuting the gel to give a particulate copolymer product and optionally rinsing with methanol, (f) hydrolyzing the copolymer particles as a slurry in methanol with acid or base to give PVOH/PVAm particles, and optionally but preferably, (g) washing the particulate PVOH/PVAm with methanol to remove soluble salts and by-products and removing the solvent from the copolymer product, especially by vacuum or thermal stripping.

Although the preferred vinyl ester used in making these copolymers is vinyl acetate, other vinyl esters such as the vinyl esters of formic acid and $C_3$–$C_{12}$ alkanoic acids, benzoic acid or trifluoroacetic acid can be used. While N-vinylformamide is the preferred vinylamide monomer, other vinylamides such N-vinylacetamide or vinylamides in which the nitrogen is substituted with a methyl group or other alkyl or hydroxyalkyl groups containing 1 to 4 carbon atoms can be used. N-vinylcarbamates, particularly O-t-alkyl-N-vinylcarbamates may also be used.

The polymers used in the invention are prepared by a free radical continuous or batch polymerization process. The continuous process gives more uniform molecular weight distribution and uniformity of comonomer incorporation (i.e., a substantially random homogeneous copolymer), improves the lot-to-lot uniformity and offers the commercial advantages of continuous operation. The batch process allows production in simple batch equipment and can be carried to high conversion to avoid monomer stripping.

Suitable free radical initiators for the polymerization reaction include organic peroxides, such as t-butyl peroxypivalate, di(2-ethylhexyl)peroxydicarbonate, t-butyl peroxyneodecanoate and azo compounds such as 2,2'-azobisisobutyronitrile. The concentration of the initiator in the polymerization reaction mixture normally ranges from 0.0001–2 wt. %, the preferred concentration being 0.001–0.5 wt. %.

Preferably the copolymers are prepared using a train of continuous stirred tank reactors followed by a hydrolysis, or alcoholysis, reaction. Vinyl acetate, N-vinylformamide, free radical initiator and methanol are added continuously to the first reactor. The N-vinyl formamide comonomer can be added to subsequent reactors in order to maintain a homogeneous copolymer. Also N-vinylformamide can be homopolymerized to form poly(N-vinylformamide), (PNVF), in aqueous or organic or mixed solvents.

In the copolymer process unreacted vinyl acetate is removed from the exit stream by contacting it with methanol vapors in a stripping column yielding an intermediate vinyl acetate random copolymer [PVAc/PNVF] having the formula III.

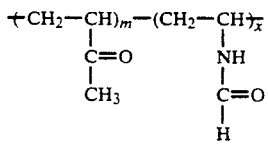

III.

wherein m = 1–99 mole % and x = 1–99 mole %.

A suitable process for preparing the PVAc/PNVF and subsequent hydrolysis to PVOH/PNVF is essentially like the process described in U.S. Pat. No. 4,675,360 directed to vinyl alcohol/poly(alkyleneoxy) acrylate copolymers, the disclosure of which is incorporated hererin by reference.

Stripping of unreacted vinyl acetate is most conveniently done for continuous processes by countercurrent contacting of the polymer paste solution with hot solvent. Stripping can be avoided by fully converting the monomers as in many batch processes. N-vinylformamide or other vinyl amides are more difficult to remove from the solution polymer, but their higher reactivity than vinyl acetate in the polymerization and frequently lower levels of incorporation minimize the amounts of these monomers present in the final product.

The polymers used in the invention can also contain other comonomers, such as for example, (meth)acrylate, crotonate, fumarate or maleate esters, vinyl chloride, ethylene, N-vinylpyrrolidone, and styrene in amounts ranging from about 2 to 20 mole %.

The hydrolysis of the PVAc/PNVF can be conducted batch or continuously with acid or base catalysis in various solvents. It is more conveniently done in methanol, optionally with various levels of water, via base catalyzed transesterification. The reaction gives methyl acetate as a volatile coproduct and PVOH copolymer as a solvent swollen but insoluble separate phase. The level of PVAc hydrolysis is adjusted by varying the base addition level and reaction time, but becomes essentially complete during base initiated PNVF hydrolysis in the subsequent step.

The transesterification solvent (for example methanol) level can be varied over wide ranges which should exceed the amount required by reaction stoichiometry and preferably provide sufficiently low viscosity for efficient mixing of added catalyst and for heat removal. Desirably, a powdery product is obtained directly in a batch hydrolysis using a vessel with efficient stirring by adding large amounts of methanol, for example a 10-fold excess over PVAc copolymer, but high levels of methanol give lower polymer throughput or require larger equipment. Continuous hydrolysis of copolymer with base can be conveniently practiced at 20–60% polymer solids by mixing the base catalyst with the alcohol solution of the copolymer and extruding the mixture onto a moving belt, much as is done commercially for the preparation of PVOH homopolymer. The hydrolyzed polymer in the form of a methanol/methyl acetate swollen el is then ground and can be rinsed with fresh methanol to remove catalyst residues and methyl acetate. The resulting methanol swollen polymer can be dried or, preferably, used as is in the subsequent PNVF hydrolysis step.

THE PVOH/PNVF has the following formula IV.

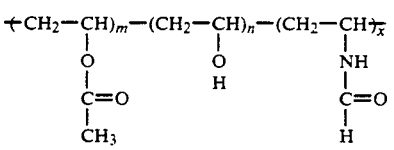

IV.

where m is 0–15 mole %, preferably 0–2 mole % for subsequent base hydrolysis to the vinylamine copolymer, n is 1–99 mole %, and x is 1 to 99 mole %.

The hydrolysis of PNVF to PVAm or PVOH/PNVF to PVOH/PVAm can be accomplished by base or acid hydrolysis. Base hydrolysis, preferably with alkali hydroxide (NaOH or KOH) or alkaline earth hydroxide, requires 0.7 to 3 times, preferably 1 to 1.5 times, stoichiometric quantities based on PNVF, and is best conducted at elevated temperatures (50–80° C.). The base or acid hydrolysis reaction can be accomplished in aqueous solution. In this case the product is recovered by precipitation or solvent evaporation. A two phase hydrolysis as a slurry of methanol swollen PVOH/PNVF particles in methanol is also possible. The two phase reaction is initially fast, but slows down after partial conversion, probably reflecting slow reaction with less accessible formamide groups. Conversion after 24 hours is about 85% but can be raised to 93% by adding small amounts of water in amounts of 1 to 20 wt. %, based on methanol. The slurry can comprise 10 to 65 wt. %, preferably 20 to 50 wt. %, polymer particles in methanol. Contemplated as the functional equivalent of methanol as the liquid medium of the slurry are $C_2$–$C_6$ alkyl alcohols and diols and $C_4$–$C_8$ alkyl ethers. The methanol can also contain methyl acetate from the hydrolysis of any remaining PVAc component. The two phase hydrolysis has the advantage that the products can be separated from the liquid phase, rinsed, and dried to produce a salt-free primary amine functional polymer in a commercially practical process.

The poly(vinylamine) homopolymer can be prepared in like manner using N-vinylformamide as the sole monomer with subsequent hydrolysis of the amide groups to the amine functionality. As discussed in formation of the copolymer, other amides such as N-vinylacetamide, can also be used in forming the homopolymer. Preferably, hydrolysis will be essentially complete, e.g. 90 to 100%. Partial hydrolysis up to this level is, however, suitable.

Synthesis of the copolymers by copolymerization of vinyl acetate and vinylformamide with subsequent hydrolysis to the polyvinyl alcohol/poly-vinyl formamide and further hydrolysis to the polyvinyl alcohol/polyvinyl amine copolymer, is described in copending application Ser. No. 7,428,805 filed Oct. 30, 1989.

The amine functional polymers used in this invention have a weight average molecular weight of about 10,000 to 7 million, and preferably from 300,000 to 2 million.

In preparing the polyvinylaminals it is preferred that the concentration of copolymer or homopolymer be about 5 to 40 wt. % in a water alcohol mixture. The alcohols which are used are alcohols having 1 to 6 carbons preferably the $C_1$–$C_4$ alcohols and the concentration of alcohol can vary from about 5 to 70 wt. % of the water alcohol mixture, but is preferably about 10 to 30 wt. %.

Suitable aldehydes for preparing the amine functional polyvinyl-aminals are monoaldehydes which include aliphatic aldehydes such as formaldehyde, acetaldehyde, butyraldehyde, hexylaldehyde, 2-ethyl hexaldehyde, octylaldehyde and the like, aromatic aldehydes such as benzaldehyde, and substituted aromatic aldehydes such as the hydroxy substituted aromatic aldehyde, salicylaldehyde. Best results in papermaking are realized when using monoaldehydes having from 2 to 12, preferably 2 to 8, carbon atoms per molecule. Butyraldehyde and hexylaldehyde are most desirable, as shown in the Examples.

The concentration of the aldehydes in the aminalization mixture is about 0.02 to 0.5, preferably 0.05 to 0.4, mol of aldehyde per mol of vinylalcohol and vinylamine units in the polymer chain. The aldehyde can be introduced either as a liquid or as a gas.

Suitable acid catalysts for preparing the aminals are the mineral acids such as hydrochloric acid, sulfuric acid, or perchloric acids and organic acids such as acetic, trifluoroacetic, arylsulfonic and methanesulfonic acids. The concentration of the acid catalyst is from about 0.001 to 20%, preferably 1 to 5% based on the weight of the polymer being aminalized.

Reaction temperatures for the acetalization can range from about 20° to 120° C., but preferably the temperature is about 30° to 80° C. Reaction times can run from 0.5 to 10 hours or more, but preferably the reaction will be complete in 0.5 to 5 hours.

In the homogeneous method which is preferred, the reaction is carried out in aqueous solution of the polymer. A heterogeneous method can be used, however, in which the polymer is present either as a powder or a film. The reaction can also be carried out in a homogeneous phase initially, but with the polymer precipitating at about 30% aminalization and at that point the reaction is continued using the heterogeneous system. Another procedure is referred to as the dissolution method in which the reaction is initially in a heterogeneous system with the polymer powder suspended in a solvent which then dissolves the aldehyde and the final product.

In the formula I given above for the structure of the polymer, the aminalized portion of the polymer is formed from two of the monomer units derived from either the alcohol or the amine units. The reaction with the aldehyde occurs with the polymer on adjacent monomer units involving either hydroxy or amine functionality. The most common form of the aminalized unit will be where in the formula I the atoms represented by A and D are both either oxygen of NH, but it should be understood that units can also be present in the which either A or D is oxygen and the other A or D in the unit is NH.

In the Examples which are given subsequently, the amine functional polyvinyl aminals were in the hydrochloride salt form, but the neutralized or free base form of the polymer is believed to behave essentially the same way in fines retention at the low concentrations employed and the pH of the stable solutions used.

The amount of aldehyde which is used in forming the amine functional polyvinyl aminals for the papermaking process can fall within the full range as given in formula I, but for papermaking we prefer to use a polymer which has been modified with about 5–30 mole percent monoaldehyde (mole of aldehyde per mole of MER unit of the polyvinylamine times 100). This modification of the poly(vinylamine) with the monoaldehyde has the effect of increasing the hydrophobicity of the polymer. This polymer exhibits an excellent ability to flocculate and retain, in the formed sheet, a high percentage of the numerous types of fine particles which are normally present in recycled waste pulp. Such fines are made up, for example, of small cellulose fibers, clays, calcium carbonate, silicas, and the like. In general, any particles below about 76 microns are considered fines, but as a practical matter it depends in each papermaking process upon the nature of such particulates and whether they tend to separate from the bulk of the paper fiber as it is formed into paper sheet.

The polymer is placed in solution in water and the solution is then added to the pulp slurry. The amount of polymer used will differ depending upon the nature of the pulp itself. This is shown by Example VII where the highest percent improvement in fines retention is achieved with different levels of polymer for recycle of newsprint, tissue paper, office waste and waste kraft. This process can readily be optimized for any particular papermaking operation when fines retention is an objective. In general the amount of polymer on a weight basis per weight of slurry solids will range from 0.005% to 2%, preferably 0.025 to 1.25% and even more preferably from 0.025 to 0.2 weight percent.

In order to describe our invention further, the following examples are presented which should be construed as illustrative only and not to limit unduly the scope of the invention.

EXAMPLE I

This example demonstrates a polymerization process for making the copolymer PVAc/PNVF. A continuous polymer paste process was followed for making PVAC/PNVF using two 2,000 ml jacketed reaction vessels and a surge vessel with bottom outlets and a methanol stripper column. Each reaction vessel was equipped with a stirrer, feed lines, thermocouple, nitrogen sparge line and reflux condenser. The reaction vessels were connected in series by a gear pump with variable speed motor. The methanol stripper was a 70 cm×75 mm column, containing 8×8 mm Raschig rings in the top two thirds and 6×6 mm Raschig rings in the bottom third. At the top of the column was a take-off condenser and a methanol boiler was connected to the bottom of the column.

Table 1 shows the initial charges that were added to reactors I and II for preparation of a copolymer containing 6 mol percent PNVF (PVAc/6% PNVF). Continuous feeds, 1, 2 and 3 were added to reaction I and feed 4 to reactor II at the hourly feed rates shown in Table 1. When the reactor temperatures approached 60° C., the feeds were begun. The flow rates from reactor I to reactor II and from reactor II to the paste collecting port were adjusted to maintain reactor I and reactor II levels. Free monomer (vinyl acetate and N-vinylformamide) in reactors I and II was monitored periodically by a titration method. Percent unreacted N-vinyl formamide was determined by chromatography. The amount of catalyst added into reactor I was varied to adjust percent vinyl acetate at steady state.

Once initial equilibrium was achieved, polymer paste was collected. To maximize paste yield at the end of a sequence, reactor I was cooled to ambient and its feeds were discontinued but the feeds ( including from reactor I) to reactor II were maintained. When reactor I was empty, the feed to reactor II was discontinued and the contents of reactor II were cooled and commingled with prime material.

Paste was poured or pumped continuously into the surge vessel and pumped to the top of the heated methanol stripper for removal of vinyl acetate. The paste was restripped as necessary to achieve a vinyl acetate level below 0.1%.

TABLE 1

| Initial Charges (g) | Reactor I | Reactor II |
|---|---|---|
| N-vinylformamide (75% Basis) | 21.3 | 7 |
| Vinyl acetate (distilled) | 460 | 248 |
| Methanol | 1,001 | 1,048 |
| Lupersol 10* | 0.12 | 0.12 |
| Tartaric Acid | 0.02 | 0.02 |
| **Feeds** | **g/h** | **mL/h** |
| 1. Vinyl acetate (dist.) | 370 | 440 |
| N-Vinylformamide (Dist., 75%) | 21.3 | |
| 2. Methanol | 150 | 190 |
| Lupersol 10 | 0.43 | |
| 3. Methanol | 107 | 135.5 |
| Tartaric acid | 0.012 | |
| 4. Vinyl acetate | 12 | 12.35 |

*Lupersol 10 is t-butylperoxyneodecanoate available commercially from Penwalt Corp.

Reactor temperatures were 60–63° C. throughout the polymerization. A higher molecular weight PVAc/6% PNVF paste was collected after initial equilibration when the concentration of vinyl acetate was 30–43% in reactor I and 22–35% in reactor II by titration.

"Prime" PVAc/6% PNVF paste was collected as the free monomer concentration approached 20% in reactor II. Using a catalyst concentration of 0.67% in Feed 2, free monomer was 28 to 30% in reactor I and 16 to 19% in reactor II. Percent unreacted NVF was about 0.76% in reactor I and 0.22% in reactor II. Analysis of the polymer by NMR showed a PNVF:PVAc ratio of 1/16.1, i.e. 6.2% NVF.

EXAMPLE II

This example demonstrates the hydrolysis of PVAc/PNVF to PVOH/PNVF and the subsequent hydrolysis to PVOH/PVAm.

In general, PVAc/PNVF paste was added to a flexible plastic bag. KOH (0.01 eq. on VAc) dissolved in methanol was added to the bag with thorough mixing. The bag was sealed and heated at 60° C. in a water bath for 15 minutes, precipitating the polymer as a white rubbery slab.

The PVOH/PNVF "slab" was mechanically ground into small pieces, the ground polymer was added to a round-bottom flask equipped with mechanical stirrer, temperature controlled heating mantle, nitrogen blanket, thermometer, and condenser. Methanol was added to the flask to give about 15% polymer slurry by weight. (An attempt to hydrolyze PVOH/PNVF in methanol containing 10% deionized water resulted in slightly higher percent hydrolysis.) KOH (1.2 eq. on NVF) dissolved in methanol was added to the slurry. The slurry was stirred vigorously and heated to reflux (63° C.) for 12 hours after which the slurry was cooled to ambient, filtered, washed with methanol and dried at 60° C. under house vacuum.

Hydrolysis of PVAc/6% PNVF to PVOH/6% PNVF. KOH (0.0045 g; 0.0001 mol; 0.04 mol % on VAc) was dissolved in 5 mL of methanol and added to PVAc/6% PNVF paste (50 g paste; 18.5 g of solid; 0.23 mol) with thorough mixing. The solution was poured into a plastic bag. The bag was sealed and heated at 50° C. in a water bath for 2.0 hours with no change in appearance. KOH (0.11 g; 0.002 mol; 1.0 mol % on VAc) was dissolved in 5 mL of methanol and added to the bag with thorough mixing. The bag was re-sealed and placed in the water bath at 50° C., immediately precipitating the polymer as a white rubbery slab. After 15 min., heating was discontinued and the slab was removed from the bag, mechanically ground, washed with methanol, decanted, then stored under fresh MeOH. Molecular weight measurements gave Mn-23,000, Mw=44,000 for PVOH/6% PNVF.

Slurry Hydrolysis of PVOH/6% PNVF to PVOH/6% PVAm. To a 100 mL round-bottom flask equipped with mechanical stirrer, heating mantle, $N_2$ blanket, thermometer and thermowatch were added the PVOH/PNVF polymer and 75 mL of methanol. KOH (1.05 g; 0.0187 mol; 1.36 eq. on original NVF) was dissolved in 5 mL of methanol and added to the slurry. The slurry was heated with vigorous stirring at reflux (63° C.) for 3.25 hours. Base consumption was monitored by potentiometric titration of 5 mL aliquots (MeOH-based solution) with approximately 0.1M HCl to pH=7. After heating for 3.25 hours, the slurry volume was low due to evaporation of methanol and removal of aliquots for titration. Heating was discontinued and the slurry was cooled overnight.

The following day, 50 mL of methanol was added. The slurry was reheated with vigorous stirring at reflux for 5 hours. Base consumption was monitored as above. The slurry was then cooled, filtered, washed with methanol and dried at 60° C. under house vacuum to give 6.6 g of oven dried material. This product showed complete PVAc hydrolysis and 77% PNVF hydrolysis.

EXAMPLE III

This example illustrates a preferred method for aminalization of poly(vinylamine). The polyvinylamine was prepared by homopolymerization of N-vinylformamide followed by hydrolysis of the amine as cited in the teachings. A round bottom flask equipped with a overhead stirred, and a water cooled condenser was charged with 100 g of a 10 wt. % solution of polyvinylamine hydrochloride in deionized water. 4.53 g (0.0629 moles) of butyraldehyde in 5 mL of methanol was added. The reaction was ramped to 65° C. over 5 minutes and held at 65° C. for 2 hours.

After cooling to 25° C., the reaction mix was slowly added to 400 mL of isopropanol to precipitate the polymer. The tacky plastic precipitate was transferred to fresh isopropanol and soaked for 16 h to remove water. The polymer, now toughened, was broken into approximately 0.5 cm pieces, air dried, ground in a Wiley mill to <40 mesh, Soxhlet extracted with isopropanol for 16 h and dried at 45°-65° C. and 250 torr. Yield: 9.40 g of polymer containing 20.9 mer % butyraldehyde based on $^{13}C$ NMR; Ash: not detectable; Moisture: 2.44%, Residual isopropanol: 9.0%.

EXAMPLE IV

This example illustrates a preferred method for aminalization of poly(vinylamine). The polyvinylamine was prepared by homopolymerization of N-vinylformamide followed by hydrolysis to the amine as cited in the teachings. A 2L resin kettle equipped with an overhead stirrer, and a water cooled condenser was charged with 1375 g of a 5.0 wt. % solution of 1.3 million $M_w$ polyvinylamine hydrochloride in deionized water. The solution was at pH 1.5. A solution containing 31.2 g (0.433 moles) of butryaldehyde in 80 mL of methanol was added below the surface over 1.5 hours while stirring the reaction at 25° C. After holding the temperature for one hour at 25° C., the reaction was ramped to 65° C. over one hour, followed by cooling to 25° C.

The cooled reaction mix was slowly added to 4 L of acetone to precipitate the polymer. The tacky plastic precipitate was transferred to fresh acetone and soaked for 4 h to remove water. The polymer, now toughened, was broken into approximately 0.5 cm pieces, dried at 60° C. and 250 torr, pulverized in a Wiley mill to <40 mesh, and dried at 40° C. and 0.75 torr. Yield: 64.8 g of polymer with 19.2 mer % butyraldehyde incorporation based on $^{13}C$ NMR. Residual isopropanol:3.9%.

EXAMPLE V

This example illustrates the aminalization of PVOH/12% PVAm under acidic conditions. A round bottom flask equipped with a overhead stirred, and a water cooled condenser was charged with 100 g of a 10 wt. % solution of coPVOH/12% PVAm (0.221 moles of alcohol plus amine). The solution was adjusted to pH 1 with concentrated hydrochloric acid. 0.7961 g (0.0111 moles) of butyraldehyde dissolved in 5 mL of methanol was added. The reaction was ramped to 65° C. over 5 minutes and held at 65° C. for 2 h. After cooling to 25° C., the reaction mix was slowly added to 300 mL of isopropanol. The precipitated polymer was washed in isopropanol, air dried, pulverized to <40 mesh, washed with isopropanol, and dried at 60° C. and 250 torr. Yield: 9.95 g of coPVOH/11.7% PVAm, with 4 mole % butyraldehyde incorporation based on $^{13}CNMR$:8% of the oxygen was reacted to the acetal (—O—CH($C_3H_7$)—O—) structure. No aminal (—N-H—CH($C_3H_7$)—NH—), was detected.

EXAMPLES VI-IX

Tests were conducted using various samples or recycled pumps representing different kinds of paper waste. These different pulps were blended with alum, additional clay and water. The whole mixture was then pH adjusted to 5.5. Using a Britt Jar and TAPPI test method 261 pm-80 (corrected 1980), the consistency, total fines and percent fines retention of the untreated pulp mixture were determined. Polymer was then added to this pulp mixture. Britt Jar tests were then conducted on each of these slurries at various polymer dosage levels. The percent fines retention was again determined using the TAPPI 261 procedure. The measured difference between the initial percent fines retention and the polymer treated percent fines retention was then reported as the percent fines retention improvement attributed to that polymer at that particular dosage.

The procedure for the Britt Jar Test was as follows:

A slurry was prepared as described above. The following steps were then taken to test the slurry for fines retention using the Britt Jar.

1. The percent consistency was determined by vacuum filtration of 100 mls of slurry. The material was then dried and weighed. The exact consistency was then calculated as follows: (dry weight/initial weight)×100.

2. Total fines of the slurry was then determined. 500 mls of the slurry was placed in the Britt Jar apparatus containing a 125P screen (76 micron). The agitator was run at 750 RPM. The bottom orifice was opened and completely drained into a catch beaker. 500 mls of wash water, (solution of water containing 0.01% Tamol 850, 0.01% sodium carbonate and 0.1% sodium tripolyphosphate), was added to the Britt jar and again agitated at 750 RPM. The bottom orifice was again opened to completely drain to a catch beaker. This procedure was continued until a clear filtrate was observed. At this point 500 mls of the wash water was added to the material remaining on the screen. This was filtered through a preweighed filter paper. The paper was dried, then reweighed and the total fines was calculated as follows:

(1) (initial weight × % consistency) = % solids.

(2) (1- (dried weight/% solids)) = % total fines.

Tamol 850 is an aqueous acrylic polymer solution marketed by Rohm and Haas as a dispersing agent.

3. Finally a blank percent fines retention was determined for the slurry. 500 mls of the slurry was weighed in a beaker. To this was added 100 mls of wash water. The whole mixture was then put into the Britt jar and agitated for 1 minute at 750 RPM. The bottom orifice was then opened and material was drained into a clean, preweighed beaker for 30 seconds. The beaker with the filtrate was then weighed and vacuum filtered on preweighed filter paper. The filter paper was then dried and reweighed. The percent fines retention was calculated as follows:

(1) (initial weight × % consistency × % total fines) = % total fines in blank (2) ((filtrate weight/initial weight) × % total fines in blank) = % fines in filtrate (3) 1-(dried weight/% fines in filtrate) = % fines retention.

4. Polymers were tested by adding the desired dosage of polymer to 500 mls of slurry and then proceeding with step 3, (as described above). Results are reported as a percent fines retention improvement over the blank percent fines retention.

EXAMPLE VI

A slurry was prepared using recycled newsprint, 20% clay, 1% alum and water. The pH of the slurry was adjusted to 5.5. The slurry was then tested for consistency, total fines and fines retention using a Britt Jar and TAPPI test method 261. Next, polymer was added at varying dosage levels from 0.25% to 1.25% (dry polymer based on slurry solids). The four polymers tested were poly(vinylamine hydrochloride) obtained by acid hydrolysis of poly(N-vinylformamide) and having a molecular weight of $4\times10^5$, C4 modified poly(-vinylamine hydrochloride) prepared in Example IV, Betz 695 and Polymin SNA PEI. Betz 695 is a very high molecular weight commercial cationic copolymer, containing acrylamide and a cationic comonomer such as diallyl dimethyl ammonium chloride. Polymin SNA PEI is a modified polyethyleneimine marketed by BASF. Molecular weight given for the modified and unmodified poly(vinylamine hydrochlorides) are for the polymer without the HCl. Percent fines retention was calculated for each polymer and dosage level. The percent fines retention improvement over the untreated pulp sample was the calculated and graphed as a function of the percent polymer added. These results are shown in Table 1 and FIG. 1. In FIG. 1, plot A is for $C_4$ modified PVAm.HCl, plot B is Betz 695, plot C is PVAm.HCl (not modified) and plot D is Polymin SNA PEI. The C4 modified poly(vinylamine hydrochloride) displayed the best percent fines retention improvement. Next were the poly(vinylamine hydrochloride) polymer and Betz 695. The Polymin SNA PEI displayed only modest percent fines retention improvement.

TABLE 1

| Polymer Dosage | % Fines Retention Improvement Recycled Newsprint | | | |
|---|---|---|---|---|
| | Betz 695 | Polymin SNA PEI | PVAm-HCl $4\times10^5$ | C4 Modified PVAm-HCl |
| 0.25% | +5.2 | +12.8 | +9.7 | +28.4 |
| 0.5% | +24.3 | +15.1 | +15.8 | +39.3 |
| 0.75% | +34.9 | +16.2 | +22.5 | +48.6 |
| 1.0% | +35.9 | +17.0 | +32.1 | +59.5 |
| 1.25% | +33.4 | −1.0 | +44.7 | +61.3 |

EXAMPLE VII

Figure 2:
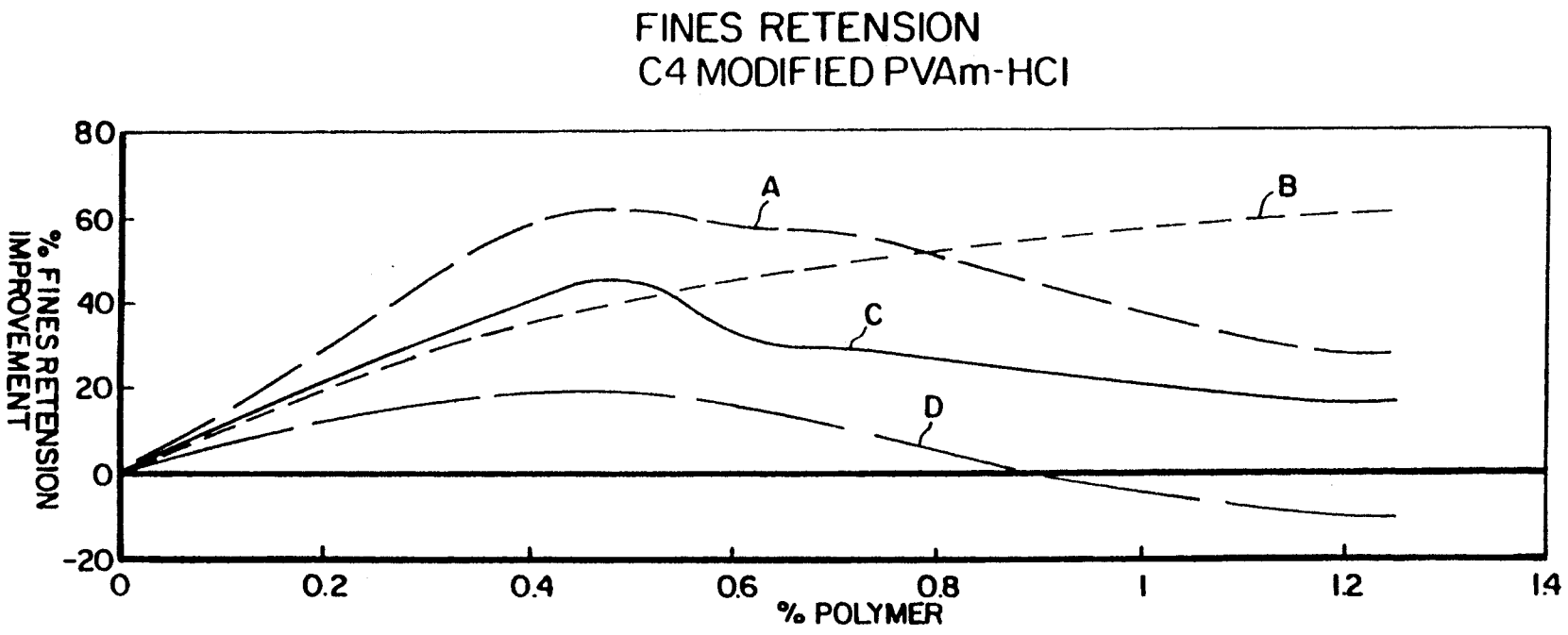
FIG. 2 is a graph plotting fines retention improvement against polymer usage level showing performance of the present invention in various types of recycled wastepaper.

Slurries were prepared as in Example VI except that in each of three slurries recycled newsprint was replaced with office waste, recylced tissue pulp and waste kraft. Slurries were again tested for consistency, total fines and percent fines retention using the Britt jar and TAPPI method 261. The only polymer tested here was the C4 modified poly(vinylamine hydrochloride). This polymer was again added at varying dosage levels (0.25% to 1.25% dry polymer based on slurry solids) for each of the pulp types. Substantial percent fines retention improvement was observed with all pulps. Results are shown in Table 2 and FIG. 2. In FIG. 2, plot A is for office waste, plot B for newsprint, plot C for tissue pulp and plot D for kraft.

TABLE 2

| Polymer Dosage | % Fines Retention Improvement in Recycled Pulps with C4 Modified Poly(Vinylamine Hydrochloride) | | | |
|---|---|---|---|---|
| | Newsprint | Tissue Paper | Office Waste | Waste Kraft |
| 0.25% | +28.4 | +27.6 | +33.2 | +15.5 |
| 0.5% | +39.3 | +54.0 | +63.1 | +23.2 |
| 0.75% | +48.6 | +33.2 | +61.5 | +9.7 |
| 1.0% | +59.5 | +17.7 | +33.6 | −7.1 |
| 1.25% | +61.3 | +16.8 | +27.4 | −10.8 |

EXAMPLE VIII

Slurries were again prepared as in Example VI using all four types of recycled pulps previously tested. Polymer dosages were decreased to 0.025% to 0.2% addition levels. Percent total fines retention improvement was determined using the Britt Jar and TAPPI method 261. The C4 modified poly(vinylamine hydrochloride) polymer was tested along with a similar commercial Betz polymer, CDP-713, Polymin P (polyethyleneimine), C12 modified poly(vinylamine hydrochloride) having a molecular weight of $6.4\times10^5$, and poly(vinylamine hydrochloride)s of two different molecular weights ($4\times10^5$ and $8\times10^5$). Results indicated that the C4 modified poly(vinylamine hydrochloride) either outperformed or was equivalent to the best commercial product (Betz CDP-713) tested and far superior to all the other commercial and amine functional polymers tested. Results are shown in Table 3.

TABLE 3

| | % Fines Retention Improvement | | | |
|---|---|---|---|---|
| | Office Pulp | News-print | Tissue Paper | Waste Kraft |
| Betz CDP-713 | | | | |
| 0.025% | +9.6 | −6.1 | +0.5 | +1.8 |
| 0.2% | +26.2 | −1.5 | +22.3 | +2.9 |

TABLE 3-continued

| | % Fines Retention Improvement | | | |
|---|---|---|---|---|
| | Office Pulp | News-print | Tissue Paper | Waste Kraft |
| 0.5% C4 modified PVAm-HCl | +57.3 | +13.3 | +51.7 | +4.2 |
| 0.025% | +4.5 | +0.1 | −2.3 | +1.6 |
| 0.2% | +31.2 | +12.9 | +15.4 | +24.4 |
| 0.5% | +51.4 | +41.2 | +54.0 | +63.1 |
| C12 modified PVAm-HCl | | | | |
| 0.025% | +4.8 | −4.8 | −7.4 | no data |
| 0.2% | +12.2 | +2.7 | +2.3 | +1.9 |
| 0.5% | +23.1 | +16.8 | +14.5 | no data |
| PVam-HCl ($4 \times 10^5$) | | | | |
| 0.025% | +6.3 | −2.6 | −5.1 | no data |
| 0.2% | +11.5 | +0.6 | +2.0 | +2.6 |
| 0.5% | +23.2 | +19.5 | +4.9 | +11.8 |
| PVAm-HCl ($8 \times 10^5$) | | | | |
| 0.025% | −1.3 | −2.2 | +0.8 | no data |
| 0.2% | +7.5 | +0.3 | +11.2 | 0.0 |
| 0.5% | +35.3 | +11.1 | +30.2 | no data |
| POLYMIN P | | | | |
| 0.025% | no data | −0.7 | +1.0 | no data |
| 0.2% | no data | +6.2 | +16.5 | no data |
| 0.5% | no data | no data | +14.7 | no data |

EXAMPLE IX

The procedure of the preceding examples were repeated using poly(vinylamine hydrochloride)s modified by reaction with several different monoaldehydes. The resultant polymers were tested at 0.025% and 0.20% levels for fines retention with recycled newsprint. The results are shown in Table 4:

TABLE 4

| Monoaldehyde: | Polymer* Molecular Weight | Polymer level: | % Fines Retention Improvement 0.025% | 0.20% |
|---|---|---|---|---|
| Acetaldehyde (C2) | $6.4 \times 10^5$ | | +6.2 | +14.5 |
| Butyraldehyde (C4) | $9 \times 10^5$ | | +4.9 | +18.5 |
| Hexylaldehyde (C8) | $6.4 \times 10^5$ | | +5.9 | +24.5 |
| Octylaldehyde (C8) | $6.4 \times 10^5$ | | +5.3 | +8.8 |

*Without HCl

The above data demonstrate that the C6 modified polymer was as effective or better than the C4 modified polymer in enhancing fines retention for recycled newsprint. All four polymers performed well.

The foregoing examples demonstrate that the polymer which is used according to our invention has either outperformed or achieved equal performance to well known commercial products. By employing this polymer as a retention aid and flocculent, fine particles from the pulp slurry are more efficiently retained in the final paper sheet providing a product with better, more consistent properties. In addition, the process water separated from the pulp has an improved clarity with lower fines content.

While not to be bound by theory, it is believed that the polymer added helps to negate the negative charges on the fine particles and that the long chain length of the polymer then enables it to bind together with the loose fine particles and the larger cellulosic fibers present in the pulp slurry. Upon sheet formation, these fine particles remain attached to the longer fibers and improve many aspects of the papermaking process.

Other aspects and embodiments of our invention will be apparent to those skilled in the art from the above disclosure without departing from the spirit or scope of our invention.

We claim:

1. In a papermaking process wherein paper product is obtained from a pulp slurry containing fine particles of material, the improvement comprising adding to said pulp slurry an amine functional polymer containing acetal groups and having monomeric units randomly joined in the proportions and structures indicated by the formula:

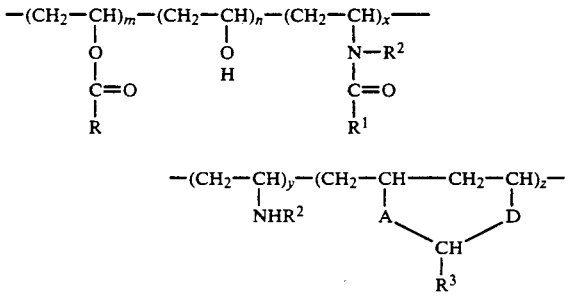

wherein m, n, x, y and z are integers which added together equal a sum, m is 0 to 15 percent of said sum, n is 0 to 94 percent of said sum, x is 0 to 30 percent of said sum, y is 1 to 95 percent of said sum, z is 1 to 60 percent of said sum;

A and D are O or $NR^2$,

R is H, $C_1$–$C_{11}$ alkyl, phenyl, or $—CF_3$, $R^1$ is H or methyl, $R^2$ is H or $C_1$–$C_4$ alkyl or hydroxyalkyl, and $R^3$ is H, $C_1$–$C_{20}$ alkyl, phenyl or hydroxyphenyl.

2. The process of claim 1 wherein said poly(vinylamine) is a homopolymer.

3. The process of claim 1 wherein said poly(vinylamine) is a copolymer of vinyl alcohol and vinylamine.

4. The process of claim 1 wherein said monoaldehyde has from 2 to 8 carbon atoms.

5. The process of claim 1 wherein said monoaldehyde is butyraldehyde hexylaldehyde or 2-ethylhexylaldehyde.

6. In a process for making paper from recycled paper pulp containing separable fines wherein said pulp is worked up in an aqueous slurry prior to separating paper fiber from water of said slurry, the improved method of retaining a portion of said fines with said fiber comprising adding to said slurry as a retention agent an amine functional polymer containing acetal groups and having monomeric units randomly joined in the proportions and structures indicated by the formula:

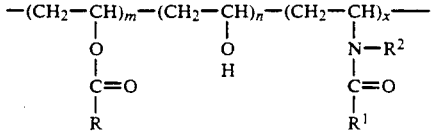

-continued

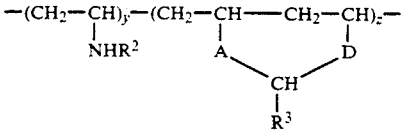

wherein m, n, x, y and z are integers which added together equal a sum, m is 0 to 15 percent of said sum, n is 0 to 94 percent of said sum, x is 0 to 30 percent of said sum, y is 1 to 95 percent of said sum, z is 1 to 60 percent of said sum;

A and D are O or $NR^2$,

R is H, $C_1$–$C_{11}$ alkyl, phenyl, or $—CF_3$, $R^1$ is H or methyl, $R^2$ is H or $C_1$–$C_4$ alkyl or hydroxyalkyl, and $R^3$ is H, $C_1$–$C_{20}$ alkyl, phenyl or hydroxyphenyl.

7. The process of claim 6 wherein m and n are zero, A and D are NH and $R^1$ is H, $R^2$ is H and $R^3$ is alkyl.

8. The process of claim 7 wherein said amine functional polymer is a polymer of N-vinylformamide which has been at least partially hydrolyzed and modified by reaction with a monoaldehyde having 2 to 12 carbon atoms.

9. The process of claim 8 wherein said monoaldehyde has from 2 to 8 carbon atoms.

10. The process of claim 7 wherein said amine functional polymer is in the form of a cationic ammonium polyvinylaminal.

11. The process of claim 10 wherein said polymer has been formed by acidic hydrolysis of poly(N-vinylformamide) followed by reaction with a monoaldehyde having 2 to 8 carbon atoms in the presence of an acidic catalyst.

12. The process of claim 11 wherein said monoaldehyde is butyraldehyde or hexylaldehyde.

13. The process of claim 6 wherein said recycled paper pulp is newsprint.

14. The process of claim 6 wherein said recycled paper pulp is waste kraft.

15. The process of claim 6 wherein said recycled paper pulp is office waste.

16. The process of claim 6 wherein said recycled paper pulp is tissue paper.

17. The process of claim 6 wherein said amine functional polymer is added to said slurry in an amount of from 0.005 to 2 weight percent of dry polymer based upon total fines present.

18. The process of claim 17 wherein said amount of polymer added is from 0.025 to 1.25 weight percent of dry polymer based upon total fines present.

19. The process of claim 1 wherein said amine functional polymer is the reaction product of monoaldehyde and poly(vinylamine).

* * * * *